United States Patent [19]

Oswald

[11] 4,354,538

[45] Oct. 19, 1982

[54] METHOD OF AGING FELLED TREES AND TREATING LUMBER

[76] Inventor: Thomas E. Oswald, P.O. Box 363, Montesano, Wash. 98563

[21] Appl. No.: 210,061

[22] Filed: Nov. 24, 1980

Related U.S. Application Data

[63] Continuation-in-part of Ser. No. 131,168, Mar. 17, 1980.

[51] Int. Cl.[3] ..... B27H 1/00

[52] U.S. Cl. ..... 144/335; 144/364; 427/440; 427/441; 428/541

[58] Field of Search ..... 144/309 R, 309 Y, 327, 144/324; 427/291, 333, 393, 440, 442, 441; 428/541; 162/DIG. 2

[56] References Cited

U.S. PATENT DOCUMENTS

| | | | |
|---|---|---|---|
| 1,025,628 | 5/1912 | Illingworth | 427/291 |
| 1,051,596 | 1/1913 | Illingworth | 428/541 |
| 1,556,570 | 10/1925 | Coolidge | 428/541 |
| 1,732,419 | 10/1929 | Rice | 427/440 |

OTHER PUBLICATIONS

Agriculture Handbook No. 528, 9/78, p. 5, *Drying Eastern Hardwood Lumber*, "Stock Preparation and Stacking".

*Primary Examiner*—W. D. Bray

*Attorney, Agent, or Firm*—Robert W. Beach; Douglas E. Winters

[57] ABSTRACT

Lumber, which is substantially warp-free and check-free and has a reduced susceptibility to decay and insect damage, particularly red alder, beech, birch, cottonwood, maple, oak, aspen and hemlock, is produced by felling the tree, preferably when in substantially full leaf; long butting the tree trunk; sealing the butt end surface to deter decay and attack by insects, and reducing the sap content by allowing the unlimbed tree to age for a minimum of six weeks; sawing the tree into lumber; purging additional sap from the lumber by soaking it with high-pressure water sprays periodically for a minimum of three days; and drying the lumber. Mold and other deterioration is deterred in wood chips which are to be stored by soaking, pressing and washing them. Red staining of alder lumber in patterns can be obtained by only partially sealing the butt end of a felled tree or holding the lumber for a time in a stagnant air environment before drying lumber cut from a felled red alder tree whether or not it has not been aged.

24 Claims, No Drawings

METHOD OF AGING FELLED TREES AND TREATING LUMBER

CROSS REFERENCE

This application is a continuation-in-part of patent application Ser. No. 131,168, filed Mar. 17, 1980, for Method of Harvesting and Seasoning Deciduous Trees.

BACKGROUND OF THE INVENTION

1. Field of the Invention

This invention relates to methods for processing certain species of wood before and/or after being cut into lumber, and more particularly to a method for preventing or deterring the warping, checking, staining, decay and susceptibility to insect damage of lumber and wood chips to improve their commercial value.

2. Problem

Red alder and birch, for example, are commonly used in furniture, cabinets and decorative woodwork. They are also used in building construction as trim, flooring, siding and paneling, but such use, as well as other structural uses, is limited because of the tendency of such wood to warp and check. When warping and checking, which is the cracking or separation of the wood lengthwise of the grain, are prevented or deterred, the quality of the wood is improved and the uses to which it can be put are increased, thereby increasing its commercial value. Such woods are also particularly susceptible to stain, blue mold and rot. Red alder is subject to red stain but birch and other species of wood are not. Further, the use of such wood in chip and pulp production is hampered because of the tendency of such wood to become infested with fungi and insects.

3. Prior Art

The Rice U.S. Pat. No. 1,732,419 discloses a process for treating wood intended to reduce warping, shrinkage and rot by immersing either logs or lumber which have not been previously dried in a sugar solution and boiling the solution until no further scum rises to the surface. To insect-proof or fungi-proof the wood Rice adds sodium fluoride to the sugar solution. Not only does the Rice process require the added expense of supplying the raw material sugar and considerable amounts of energy to boil the solution, but the added sugar promotes invasion by termites. As far as known such process has not been used commercially.

Although the Illingworth U.S. Pat. No. 1,025,628 is directed toward converting green wood of low commercial value, such as scrub pine or spruce, into a high grade elastic resilient wood, the process also purports to prevent the wood from decaying and protect it against attacks of insects. The disclosed process includes bucking the tree trunks into logs, soaking them in water until they are almost waterlogged, air-drying them in shade, sawing the logs into planks, soaking the planks in a saturated solution of lime water and covering them with unslaked lime. The process is very time-consuming and significant time and effort would be required to remove the excess unslaked lime, as well as to dry the essentially waterlogged wood. No known commercial use has been made of this process in the 68 years since that patent was granted.

SUMMARY OF THE INVENTION

A principal object of the present invention is to provide a method for preventing or deterring the warping, bowing and checking of lumber sawn from certain types of wood, particularly red alder, beech, birch, aspen, cottonwood, maple, oak and hemlock.

A further object is to provide a method of processing wood for preventing, deterring or controlling staining and preventing or deterring insect damage and rot. More specifically, it is an object to provide a method of controlling red staining of red alder, thereby producing uniquely patterned lumber.

Another object is to provide a method to reduce the amount of sap residue which is deposited in dry kilns, thereby reducing the fire hazard and cleaning problem.

An additional object is to provide a method by which sap removed from wood may be recovered and used in the production of byproducts.

DETAILED DESCRIPTION

Warping and checking of lumber sawn from trees such as alder, beech, birch, cottonwood, maple, oak and aspen may be prevented or greatly deterred by cutting the tree when in full leaf and allowing the tree to age for a period of time before bucking the tree trunk into logs and sawing the logs into lumber. Alternatively, the tree can be felled when dormant and aged either with the limbs left on, or after being delimbed, or after being bucked into logs. Before such aging, cut ends of the trees or logs must be sealed to prevent stain, mold, rot and insect infestation during the aging process.

Stain, mold, rot and insect infestation of lumber or chips cut from such trees, whether or not aged, can be deterred by repeatedly soaking the lumber or chips with water and then drying the lumber or chips.

For subjecting a tree to the most beneficial aging it is cut in the spring, summer or early fall when deciduous trees are in substantially full leaf, and preferably in the spring when the sap is up. After the tree is felled, it is long butted, that is, the base of the trunk is removed a few inches in excess of the penetration of the small openings left by strings which are pulled from the butt in felling the tree and above any cracks that may occur during felling of the tree. The cracks, checks and small openings left by the pulled fibers are removed in this manner since fungi which cause stain and rot, and especially red stain which plagues red alder, penetrate these discontinuities. Stain occurs first and may progress into rot.

The flat butt end surface of the tree trunk is then sealed. If the tree has been bucked, both ends of the log must be sealed. The sealant can be cold wax or coal tar, for example, or any composition which will prevent air, water and other matter from penetrating the cut end. Shellac and paint sealer, though known as wood sealers, will not produce an effective seal of a tree butt or log end for the purpose of this invention. Coal tar is the preferred sealant because it provides the most effective seal. Paraffin will seal the surface satisfactorily and is clean. Other sealing means, such as gluing a plastic sheet over the flat end surface of the tree or log, may be used. Since the felled tree is not debarked, all that is required to deter ingress to the interior of the tree trunk or log of bacteria, fungi and other matter which cause decay, including stain, mold and rot, and to deter ingress to the log of air and water which carry such deteriorating agents, while the tree or log is being aged, is to apply a sealing covering to the butt surface of the tree. The end seal also deters damage caused by insect attack.

It is important that deciduous trees felled while in leaf not be limbed or the leaves removed prior to aging. The tree is allowed to age, preferably lying on the ground, for six weeks to eight months during which time the sap transpires. It does not matter whether the felled tree is wetted by rain or remains dry. After a minimum of six weeks, or when the leaves are substantially dry but not necessarily withered, the tree is limbed, debarked, bucked, sawn into lumber and the lumber is loosely stacked in conventional manner.

A tree may be felled during late fall and winter when it is dormant, long butted, the butt sealed and the tree then aged. If the tree is dormant when cut there is less sap and since the sap will not transpire the tree may be limbed immediately after being felled and even bucked into logs, if desired, and the cut ends sealed before being aged. The aging time is preferably the same as for leaved trees, six weeks to eight months.

Aging the felled tree or log in accordance with the present process will virtually completely prevent future checking and warping of lumber sawn from such a tree or log of the species named above.

To deter stain, mold, rot and insect infestation of sawn lumber, whether or not the felled tree or log from which the lumber was sawn has been aged in accordance with the present process, the remaining sap can be purged from the green lumber by successive, at least daily, water soakings for a few days. Preferably the stack of lumber is soaked with water daily for at least three days. If the tree or log has not been aged before being cut into lumber, purging of the sap from the lumber by successive water soakings will take longer. It is not necessary to submerge the lumber in water but only to soak the wood thoroughly by forcefully spraying water onto it, such as with a firehose or other spraying system.

All of the lumber sawn from alder is sapwood, as distinguished from heartwood. Sapwood is much more susceptible than heartwood to checking and warping. To purge sap from sapwood the direct force of the spray must be applied. By directly spraying alder boards with water at 100 pounds pressure from a firehose held 2 feet (61 cm) from the boards on 11 consecutive days, the subsequent formation of mold was prevented. However, mold did form in 2 weeks on such boards subjected to indirect spray from the hose, that is, alder boards soaked by spray from a hose which had been directed at another board. Even indirect spray was effective in deterring mold formation on cottonwood, aspen and oak boards.

The face of a 1 inch (2.54 cm) thick unseasoned alder board cut from an aged felled tree was hosed for 10 minutes and dried. The board did not warp as would a board cut from an unaged tree or log. However, it was susceptible to rot and insect damage if allowed to become damp. By purging the remaining sap from the board by the successive hosing process described above future decay and insect damage would have also been prevented even if the board were allowed to become damp.

Hemlock lumber, 2 inches (5.08 cm) thick or less, can be soaked or sprayed with water to effectively deter rotting and warping. Soaking or spraying cottonwood, beech, maple, oak, birch and aspen lumber, as well as hemlock, cut from unaged trees removes sap and deters deterioration of the wood by rot and insect infestation.

After the lumber is soaked for at least several days, it is allowed to air dry or is placed in a dry kiln to be dried. The resulting lumber, if sawn from aged logs, is substantially unwarped and unchecked and may be used as structural material, flooring, shingles, shakes and siding, for example, as well as for furniture. The lumber is satisfactory for both interior and exterior use.

Also, when sap residue is removed from cut lumber by the sap-purging process before being dried, sap is not released from the lumber to collect in the dry kilns, thus minimizing the fire hazard and greatly reducing cleaning time and expense.

Instead of purging the sap from lumber sawn from aged felled trees with water, the lumber may simply be kiln-dried in the usual way. However if the sap-purging step is omitted, the lumber will not be completely immune from future decay, although warping is almost entirely eliminated and checking is deterred.

Boards which have been cut from alder trees that have been aged according to the present process and which boards have warped and/or bowed before being dried will be almost completely straightened by normal dry kiln drying to an 8% moisture content whether or not the boards have been purged of sap by being hosed before being dried. Wetting the aged, kiln-dried straightened alder boards will not cause them to warp or bow.

The best lumber is obtained by both aging the tree or log to deter warping and checking, and purging the sap from the lumber cut from the tree or log to prevent, or at least greatly inhibit, insect damage and decay, including red stain, mold, fungi damage and rot.

Advantage may be taken of red stain to make decorative patterns in finished alder lumber. If red stain patterns are desired, the felled tree butt or log ends are not completely sealed during the aging process. By permitting portions of an end surface, particularly the butt, to be exposed, controlled penetration of the fungi which forms the red stain is permitted. The fungi penetrates lengthwise of the tree trunk and colors the wood. The tree trunk is then sawn and kiln-dried in the normal manner.

Another method of staining alder wood is to saw the unaged or aged tree trunk into lumber and store it in an unheated dry kiln with minimal air circulation for a number of days. The moisture of the wood in the closed environment promotes red stain which colors the wood in random patterns. When the desired degree of staining is obtained, the kiln is heated and the lumber is dried in normal fashion. Such drying arrests the progress of the staining which will not increase unless the wood is subsequently moistened. These two staining methods create a unique pattern in alder wood.

If wood chips are to be stored for more than a month, mold and other deterioration can be deterred by soaking them in a water bath which is agitated mechanically or by an air or water jet. After soaking for 3 to 4 minutes in cold water, the chips can be spread on a surface and pressed to expel water and sap from the chips. The chips are then rinsed briefly to wash the expelled sap from the chips.

The water used for purging lumber or chips of sap may be recirculated and the residue from the sap reclaimed from the water as a valuable byproduct. For example, the purging water may be filtered through bales of hay and the hay, which is enriched by the sap residue, fed to cattle.

I claim:

1. The method of deterring warping and checking of lumber which comprises felling a tree, long-butting the felled tree, applying a seal covering the surface of the tree trunk butt end prior to aging the felled tree without substantial penetration of the seal into the wood to deter penetration into the interior of the tree trunk of bacteria and fungi which promote decay, including stain, mold and rot, aging the felled, long-butted and butt-sealed tree without removing the bark from the tree trunk, and sawing the log of the aged tree into lumber.

2. The method defined in claim 1, including applying a sealant for covering the tree trunk butt end surface, said sealant being selected from the group consisting of coal tar and paraffin.

3. The method defined in claim 1, including aging the felled tree for a period of at least six weeks.

4. The method defined in claim 1, including felling the tree when it is dormant.

5. The method defined in claim 1, including selecting the tree from the group consisting of alder, beech, birch, cottonwood, maple, oak, aspen and hemlock.

6. The method defined in claim 1, including aging the felled, long-butted and butt-sealed tree for a period of at least six weeks before sawing the log of the aged tree into lumber.

7. The method of deterring mold, rot and insect damage of sapwood without exposing it to alkaline material which comprises soaking the wood with water substantially devoid of chemical additives for purging sap from the wood.

8. The method of deterring mold, rot and insect damage of sapwood lumber without exposing it to alkaline material which comprises purging sap from the lumber by forcefully spraying water substantially devoid of chemical additives onto the lumber until it is soaked.

9. The method defined in claim 8 including spraying the lumber periodically.

10. The method of effecting decorative red staining of a red alder board which comprises felling a red alder tree, applying a seal covering only a portion of the tree butt end surface for enabling bacteria and fungi to penetrate the unsealed portion of the tree butt end surface, aging the tree wood, and sawing the board from that portion of the tree in at least part of which red stain has occurred.

11. The method defined in claim 1 or 6, including saturating the sawn lumber with water substantially devoid of chemical additives to deter mold, rot and insect damage of the sawn lumber without exposing it to alkaline material.

12. The method defined in claim 7, including soaking the wood for approximately three days.

13. The method defined in claim 8 or 9, in which the lumber is no greater than approximately two inches (5.08 cm) in thickness.

14. The method of deterring warping and checking of lumber cut from a deciduous tree which comprises felling the tree when in leaf and aging the felled leaved tree while substantially completely covered with bark except for the butt end of its trunk until the leaves are substantially dry; and deterring mold, rot and insect damage of lumber cut from the tree without exposing the wood to alkaline material by soaking the cut lumber with water substantially devoid of chemical additives periodically for at least three days for purging sap from the wood.

15. The method defined in claim 14, including selecting the tree from the group consisting of alder, beech, birch and aspen.

16. The method defined in claim 14, including long-butting the tree trunk and applying a seal covering the tree butt end surface prior to aging the felled tree without substantial penetration of the seal into the wood to deter penetration into the interior of the tree trunk of bacteria and fungi which promote decay, including stain, mold and rot.

17. The method defined in claim 16, including applying paraffin for covering the entire tree butt end surface and thereby sealing it.

18. The method defined in claim 16, including securing a plastic sheet onto the tree butt end surface to constitute the seal covering.

19. The method defined in claim 1 or 14, including aging the felled tree for a period of six weeks to eight months.

20. The method of deterring warping and checking of lumber cut from a deciduous tree which comprises felling the tree when in leaf, long-butting the felled tree, applying a seal covering the surface of the tree butt end prior to aging the felled tree without substantial penetration of the seal into the wood to deter penetration into the interior of the tree trunk of bacteria and fungi which promote decay, including stain, mold and rot, aging the felled, long-butted tree while substantially completely covered with bark except for the butt end of its trunk, which butt end is covered with a seal until the leaves are substantially dry, and cutting the aged tree into lumber.

21. The method defined in claim 1, 14, 15 or 20, in which the tree is red alder.

22. The method defined in claim 15 or 20, in which the tree is red alder and the tree is aged for six weeks to eight months.

23. The method of deterring mold, rot and insect damage of sapwood lumber cut from a log which comprises forcefully spraying the cut lumber with water substantially devoid of chemical additives periodically until the wood is soaked for at least three days for purging sap from the wood.

24. The method of deterring mold, rot and insect damage of sapwood lumber which comprises purging sap from the lumber by forcefully spraying onto the lumber to soak it water substantially devoid of chemical additives.

* * * * *